US009061804B2

(12) United States Patent
Delage et al.

(10) Patent No.: US 9,061,804 B2
(45) Date of Patent: Jun. 23, 2015

(54) DEVICE FOR PACKAGING A PRODUCT, IN PARTICULAR A COSMETIC PRODUCT, HAVING A SEALING MEMBER

(75) Inventors: Jean-François Delage, Clamart (FR); Lionel Drugeon, La Garenne Colombes (FR); Thierry Ramboz, Sannois (FR); Pierre Ducastin, Villennes sur Seine (FR); Bruno Cavagnero, Pierrelaye (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 13/996,056
(22) PCT Filed: Dec. 16, 2011
(86) PCT No.: PCT/EP2011/073110

§ 371 (c)(1),
(2), (4) Date: Sep. 5, 2013

(87) PCT Pub. No.: WO2012/084731

PCT Pub. Date: Jun. 28, 2012

(65) Prior Publication Data

US 2013/0334230 A1 Dec. 19, 2013

Related U.S. Application Data

(60) Provisional application No. 61/427,660, filed on Dec. 28, 2010.

(30) Foreign Application Priority Data

Dec. 21, 2010 (FR) ..... 10 60909

(51) Int. Cl.
*B65D 53/00* (2006.01)
*A45D 33/00* (2006.01)

(Continued)

(52) U.S. Cl.
CPC ..... *B65D 53/00* (2013.01); *A45D 33/00* (2013.01); *A45D 40/0068* (2013.01);

(Continued)

(58) Field of Classification Search
CPC ..... A45D 2040/223; A45D 2200/051; A01B 12/006; B65D 39/12; B65D 53/02
USPC ..... 132/218, 320, 293, 294
See application file for complete search history.

(56) References Cited

U.S. PATENT DOCUMENTS

| | | | | |
|---|---|---|---|---|
| 1,939,569 | A | 12/1933 | Pfister | |
| 7,314,051 | B2 * | 1/2008 | Yuhara et al. | 132/294 |
| 8,151,807 | B2 | 4/2012 | Holloway et al. | |

FOREIGN PATENT DOCUMENTS

| | | |
|---|---|---|
| EP | 2 030 907 A1 | 3/2009 |
| EP | 2 174 882 A1 | 4/2010 |

(Continued)

OTHER PUBLICATIONS

International Search Report for corresponding International Patent Application No. PCT/EP2011/073110, dated Jan. 26, 2012.

*Primary Examiner* — Rachel Steitz
(74) *Attorney, Agent, or Firm* — The Marbury Law Group, PLLC

(57) ABSTRACT

The present invention relates to a device for packaging a product, in particular a cosmetic product, which comprises: —a container (10; 110) which contains the product and comprises an opening; —a member (20; 120) for closing the container, said member being intended to close the container in a reversible manner and being able to move between an open position and a closed position of the container; —a sealing member (40; 140), secured to the closing member, which comprises an elastically deformable part (42; 142), the sealing member having a contour that is able to come into contact with a perimeter of a part of the container; —a holding element (30; 175) that is mounted such that it can move along an axis X inside the closing member, the holding element (30; 175) resting along the axis X against a portion of the container (36; 116) before the closing member is in its closing position, such that the axial height (h) of a space (50; 80) that houses the sealing member decreases between the open position and the closed position of the container so as to axially compress the sealing member which widens radially in order to rest against the perimeter of the container.

22 Claims, 4 Drawing Sheets

(51) Int. Cl.

| | |
|---|---|
| ***A45D 40/00*** | (2006.01) |
| ***A45D 40/22*** | (2006.01) |
| ***A45D 40/26*** | (2006.01) |
| ***B65D 39/12*** | (2006.01) |
| ***B65D 53/02*** | (2006.01) |

(52) U.S. Cl.

CPC ..... *A45D 40/22* (2013.01); *A45D 40/265* (2013.01); *A45D 2040/223* (2013.01); *A45D 2200/051* (2013.01); *B65D 39/12* (2013.01); *B65D 53/02* (2013.01)

(56) References Cited

FOREIGN PATENT DOCUMENTS

| | | | |
|---|---|---|---|
| FR | 917 052 | A | 12/1945 |
| FR | 2 853 630 | A1 | 10/2004 |
| FR | 2 924 001 | A1 | 5/2009 |
| GB | 114 962 | | 4/1918 |
| GB | 677 026 | A | 8/1952 |
| GB | 1 485 106 | A | 9/1977 |
| WO | 99/20144 | | 4/1999 |

* cited by examiner

DEVICE FOR PACKAGING A PRODUCT, IN PARTICULAR A COSMETIC PRODUCT, HAVING A SEALING MEMBER

This is a national stage application of PCT/EP2011/073110, filed internationally on Dec. 16, 2011, which claims priority to U.S. Provisional Application No. 61/427,660, filed on Dec. 28, 2010; as well as French Application No. FR 1060909, filed on Dec. 21, 2010, the entire contents of each of which is incorporated by reference herein.

The present invention relates to packaging devices intended to contain a cosmetic product, comprising a product reservoir, for example a pot or small bottle, and a member for closing the reservoir. In particular, the invention relates to such packaging devices provided with a sealing member.

In many devices for packaging cosmetic products, the closing member is screwed onto the product reservoir. It is thus fairly easy to seal the closure.

When it is desired to close packaging devices by closure means other than screwing, in particular by way of a catch, by snap-fastening, by clamping or by a bayonet-type closure, sealing is more difficult. It is known to use seals that are compressed in the closed position in order to provide sealing.

Document WO99/20144 describes, for example, a casing comprising a base and a cover hinged on the base, the base of the casing being provided with a seal. While the cover is being closed, the seal is compressed by a lip provided on the cover, which is pushed onto the seal.

Document GB114,962 also describes a casing in which a seal is in this case provided on the cover. While the cover is being closed, the seal is compressed against the free edge of the base.

However, systems based on compressed seals require that the user exert a relatively high force while closing the device.

There is a need to further improve the sealing of the closure of devices for packaging cosmetic products.

The invention aims in particular to meet this need by providing a device for packaging a product, in particular a cosmetic product, which comprises:

- a container which contains the product and comprises an opening;
- a member for closing the container, said member being intended to close the container in a reversible manner and being able to move between an open position and a closed position of the container;
- a sealing member, secured to the closing member, which comprises an elastically deformable part, the sealing member having a contour that is able to come into contact with a perimeter of a part of the container;
- a holding element that is mounted such that it can move along an axis X inside the closing member, the holding element resting along the axis X against a portion of the container before the closing member is in its closing position, such that the axial height of a space that houses the sealing member decreases between the open position and the closed position of the container so as to axially compress the sealing member which widens radially in order to rest against the perimeter of the container.

Between the closed position and the open position of the container, the axial height of the space may vary by a distance of between 0.5 mm and 5 mm, in particular of between 1.5 and 3.5 mm.

An elastically deformable element, in particular a spring, may be located between the holding element and the closing member.

The sealing member may comprise a seal made of a material selected from elastomeric rubbers and thermoplastics.

The material could, for example, be selected from among silicones, nitriles, natural or synthetic latices, EPDMs, polyurethanes, blends of polypropylene and SBS, SEBS, or EPDM, such as natural, synthetic or thermoplastic elastomers, in particular copolymers of polypropylene and of SEBS, styrene-butadiene or ethylene-vinyl acetate copolymers, very low density polyethylenes, nitrile rubbers, polychloroprene or neoprene, ethylene propylene diene terpolymers (EPDMs), butadiene-acrylonitrile copolymers, polyurethanes, plasticized polyvinyl chlorides, crosslinked rubbers, in particular those based on silicone, etc.

The seal may be annular, it being possible for the seal to have a hollow cross section having a shape selected from: a U, a circle, an oval, a C, an X, a square, a trapezium.

The container may comprise a removable refill containing the product.

The container or the refill may comprise a side wall provided with a shoulder which defines a supporting edge for the holding element. The seal may thus be pressed against the perimeter of the side wall of the container or of the refill, above the shoulder.

Alternatively, the upper edge of the container may define a supporting edge for the holding element.

The container may comprise a wiping member, against the perimeter of which the seal may rest radially in the closed position.

The closing member may be secured to a wand that carries an applicator, in particular a brush, the holding element being secured to the wand. The seal may be tubular and mounted around the wand. The tubular seal may comprise a domed part between its two ends, the domed part being able to widen radially in order to rest against the perimeter of the wiping member.

The sealing member according to the invention is particularly useful for packaging devices in which the closing member is fixed on the container in a reversible manner other than by screwing, in particular by snap-fastening, clamping, by a bayonet system, by way of a catch. Of course, the sealing member may also be used in packaging devices in which the closing member is fixed on the container by screwing.

The invention may be understood better from reading the following detailed description of non-limiting implementation examples thereof, and with reference to the attached drawing, in which:

FIG. 1 illustrates a perspective view of a pot provided with a sealing member according to the invention;

FIGS. 2 and 3 schematically show, in axial section, the pot from FIG. 1, in the open and closed position, respectively;

FIGS. 4*a* to 4*n* illustrate, in section, seals of different shapes that are used in packaging devices according to the invention;

FIG. 5 schematically and partially shows, in axial section, a variant of the pot illustrated in FIG. 3;

FIGS. 6 and 7 schematically and partially show, in axial section, a device for packaging mascara, provided with a sealing member according to the invention, in the closed and open position, respectively;

Figure 1:
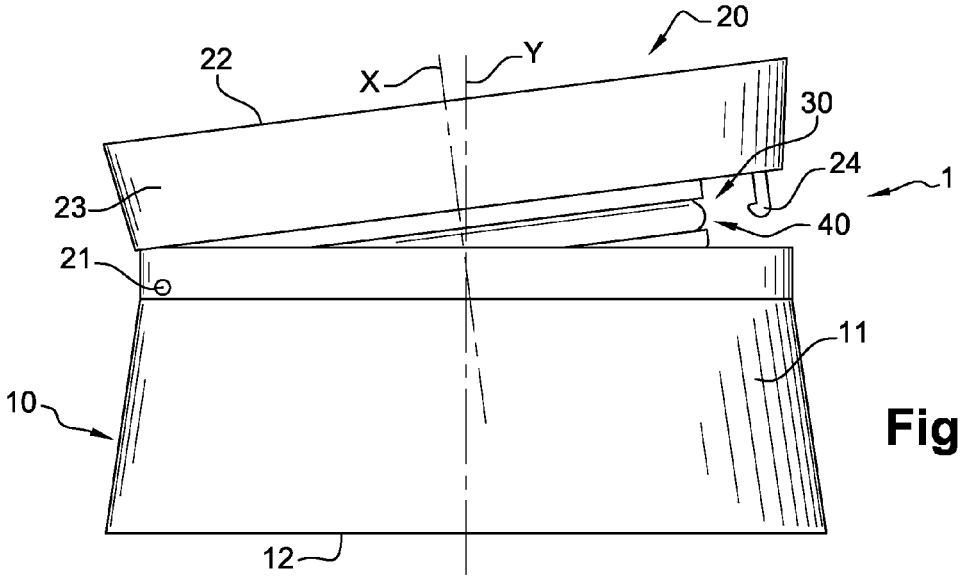
Figure 2:
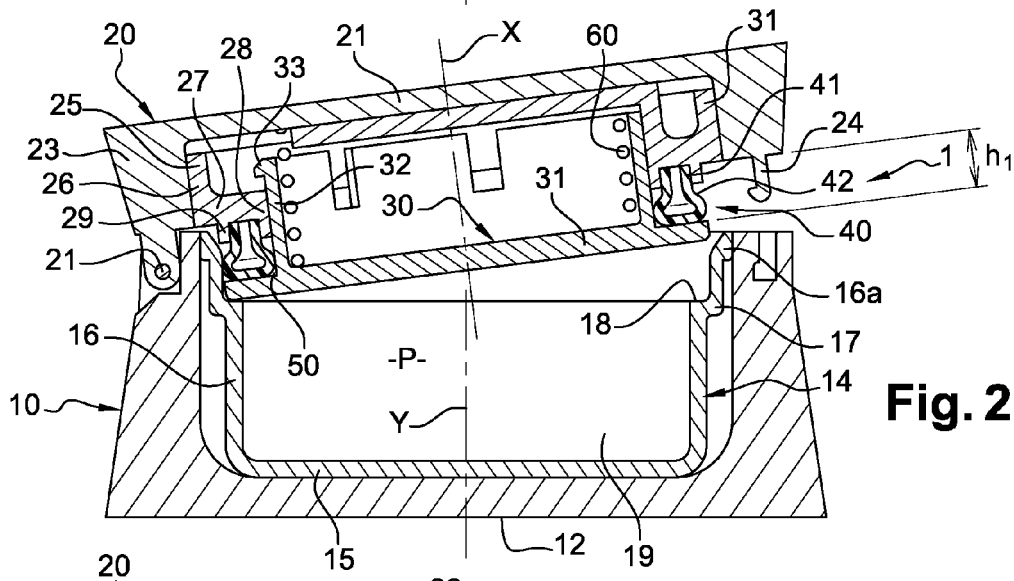
Figure 3:
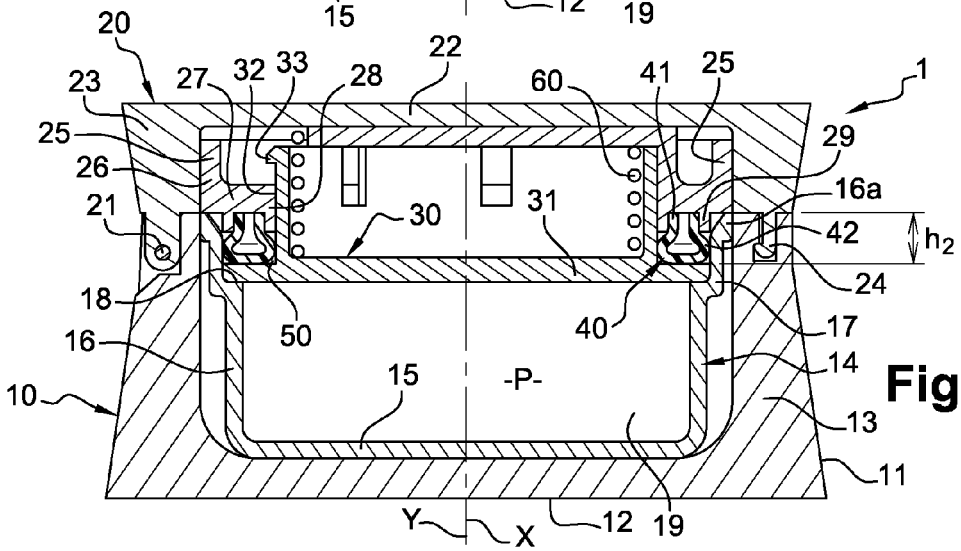

FIGS. 1 to 3 show a packaging device in the form of a pot 1. The pot comprises a container 10 having an opening of axis Y and a cover 20 which is intended to reversibly close the pot and is provided with a sealing member 40. In the example illustrated, the container and the cover have a circular cross section. Alternatively, the container and the cover may have a cross section which is not circular, in particular a polygonal or oval cross section.

Referring in particular to FIGS. 2 and 3, it is possible to see that the container 10 has an outer shell 11 and a removable refill 14 which defines a housing 19 containing a product P. The outer shell 11 comprises a bottom 12 and a side wall 13. The removable refill 14 is held in the outer shell by any appropriate means, for example by being clamped or snap-fastened to the side wall 13 of the outer shell.

The removable refill 14 also comprises a bottom 15 and a side wall 16 which defines, at its upper end 16*a*, an opening that corresponds, in the example illustrated, to the opening of the container. The side wall 16 comprises, close to its upper end 16*a*, a shoulder 17 which forms a supporting edge 18, against which, as will be seen below, a holding element 30 which is mounted in the cover may rest. It is also possible to provide a sealing disc which closes the opening of the refill, the supporting edge 18 then comprising a recess so that the sealing disc does not raise the supporting edge.

According to the embodiment illustrated in FIGS. 1 to 3, the cover 20 is hinged with respect to the container by virtue of a hinge 21 around a geometric axis of rotation which is perpendicular to the plane of FIG. 1. The cover 20 comprises an upper wall 22 and a peripheral skirt 23 which is provided, at its end opposite the hinge 21, with a clasp 24 that comprises for example a tongue that can be received under a corresponding relief on the container 10.

A support 25 is mounted in a fixed manner inside the cover in order to hold the sealing member 40. The support 25 comprises in particular a peripheral ring 26 that is fixed to the inner surface of the peripheral skirt of the cover. The ring 26 may be fixed by adhesive bonding, clamping or by any other fixing means. The ring 26 extends axially as far as the lower edge of the peripheral skirt 23 of the cover. The ring 26 is extended radially, at its lower end, by a portion 27 which extends as far as an inner ring 28 which extends it parallel to the peripheral ring 26. The transverse portion 27 comprises, on its face that is turned towards the inside of the container, a fixing skirt 29 for the sealing member.

The sealing member 40 is held by the support 25 inside the cover in order to close, in a sealed manner, the housing 19 containing the product P and to ensure airtightness and/or sealing with respect to any volatile compounds contained in the product P.

The sealing member 40 comprises an annular, deformable seal such that its outer contour rests against the annular perimeter of the inner surface of the refill 14. According to the example illustrated, the seal has a hollow cross section. It comprises a fixing skirt 41 fitted into the skirt 29 of the support, the fixing skirt 41 being extended by a deformable part 42 which, according to the example illustrated, has a circular cross section. The seal is for example produced from SEBS or EPDM.

The seal 40 extends below the lower edge of the side wall 23 of the cover and has an outside diameter approximately the same as the diameter of the inner wall of the refill 14, between the shoulder 17 and the upper edge 16*a* of its side wall.

A holding element 30 is mounted inside the cover such that it can move along an axis X with respect to the cover. The holding element 30 comprises a plate 31 that is held on the support 25 by a skirt 32 that extends axially above the plate. The skirt 32 is disposed such that it can slide along the axis X along the inner ring 28 of the support 25. The skirt 32 comprises, at its upper end, a flange 33 that extends radially outwards so as to butt against the upper edge of the inner ring 28 of the support 25. The flange 33 thus limits the descent of the holding element 30. The periphery of the skirt 32 is overlapped, radially towards the outside, by the plate 31 so that the latter is under the seal 42.

A space 50 having an axial height h is defined between the support 25 and the plate 33 in order to receive the seal 42. In the open position of the cover, the space is large enough axially to receive the seal without compressing it. However, if the seal is slightly compressed in the open position of the cover, this does not depart from the scope of the invention.

Advantageously, an elastic return member is located between the holding element 30 and the cover 20. More particularly, a compression spring 60 is fixed to the plate 31 and to the inner surface of the upper wall of the cover 22 so as to push these two components away from one another.

Figure 5:
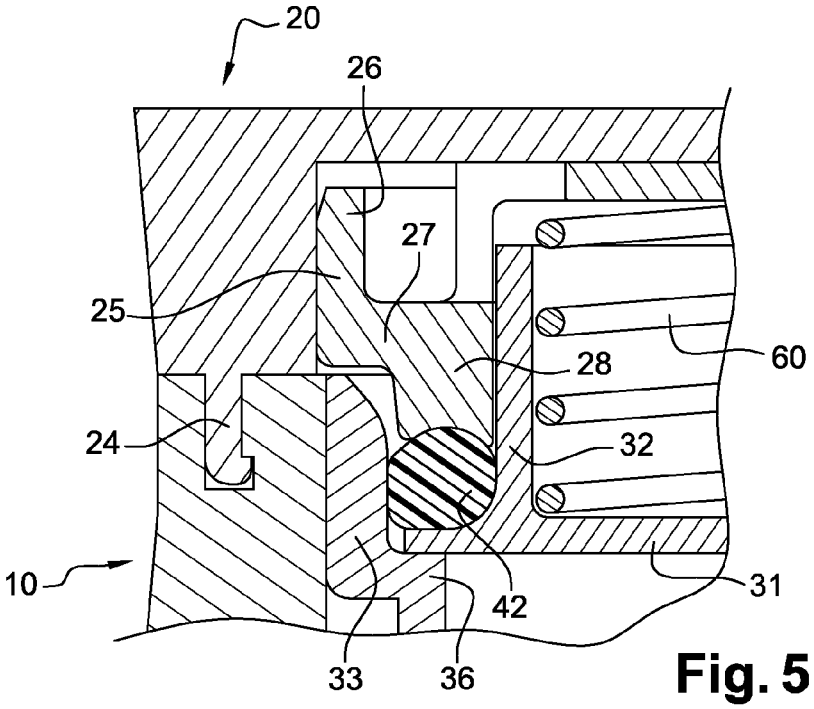

Instead of being held by a fixing skirt of the support, the sealing member 40 may alternatively by held by being clamped around the skirt 32 carrying the plate 31 of the holding element. In the closed position of the pot, the inner ring 28 compresses the seal 40 which is held by the plate 31 which is in abutment against the edge 18 of the refill in the container, as is illustrated in FIG. 5. In this variant, the seal comprises only one elastically deformable part having a circular cross section.

Figure 4A:
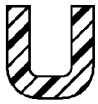
Figure 4B:
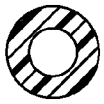
Figure 4C:
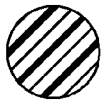
Figure 4D:
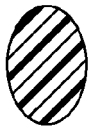
Figure 4E:
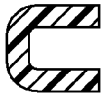
Figure 4F:
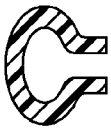
Figure 4G:
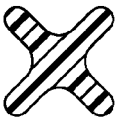
Figure 4H:
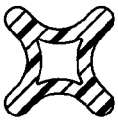
Figure 4I:
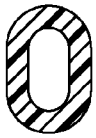
Figure 4J:
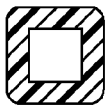
Figure 4K:
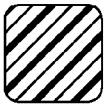
Figure 4L:
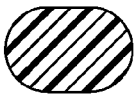
Figure 4M:
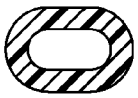
Figure 4N:
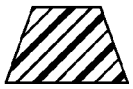

Alternatively, the seal could have a different shape from the one that has just been shown. It may have a cross section which is in particular in the form of a U, a C, a cross, an oval, a square, a trapezium, etc., as is illustrated in FIGS. 4*a* to 4*n*. Instead of being hollow, it may be solid, as is illustrated in FIGS. 4*c*, 4*d*, 4*k* and 4*l*.

As a further variant, it is possible for the pot not to comprise a removable refill. The container then directly defines the housing containing the product. According to this variant, which is not illustrated, the side wall 13 of the container is provided with an indentation that forms a supporting edge for the plate 31. Instead of being a separate component, the support 25 for the seal may alternatively be produced in one piece with the cover.

When the pot 1 is open, as is illustrated in FIGS. 1 and 2, the holding element 30 of the sealing member is in its position furthest from the cover. In particular, the spring 60 pushes the plate back in order to space it apart from the upper wall of the cover. However, the plate is held on the cover by the flange 33 of the skirt 32, which butts axially against the upper edge of the inner ring 28 of the support 25. In this position, the space 50 in which the seal 40 is housed is at a maximum and has an axial height h1.

When the cover 20 is closed, as is illustrated in FIG. 3, the plate butts against the supporting edge 18 of the refill while the seal 40 is moved axially by the support 25, against which it is held fixedly. The spring 60 is compressed such that the plate 31 is moved towards the upper wall 21 of the cover. Since the plate butts against the supporting edge 36 before the closing member is in its closed position, the space 50 housing the seal is reduced axially. The axial height h2 of the space 50 in the closed position is less than the height h1 of the space 50 in the open position, the axial height varying by a distance of for example between 1.5 and 3.5 mm. The seal 40 is then compressed axially between the plate 31 and the support 25. On account of its shape and material, the seal widens perpendicularly to the axis X and butts radially against the side wall 16 of the refill, between the shoulder 17 and the upper edge 16*a* of its side wall.

The housing 19 is thus closed in a sealed manner by the plate 31, which is in abutment against the supporting edge 18 of the refill, and by the seal 40, which ensures that this closure between the plate and the side wall of the refill is sealed.

Figure 6:
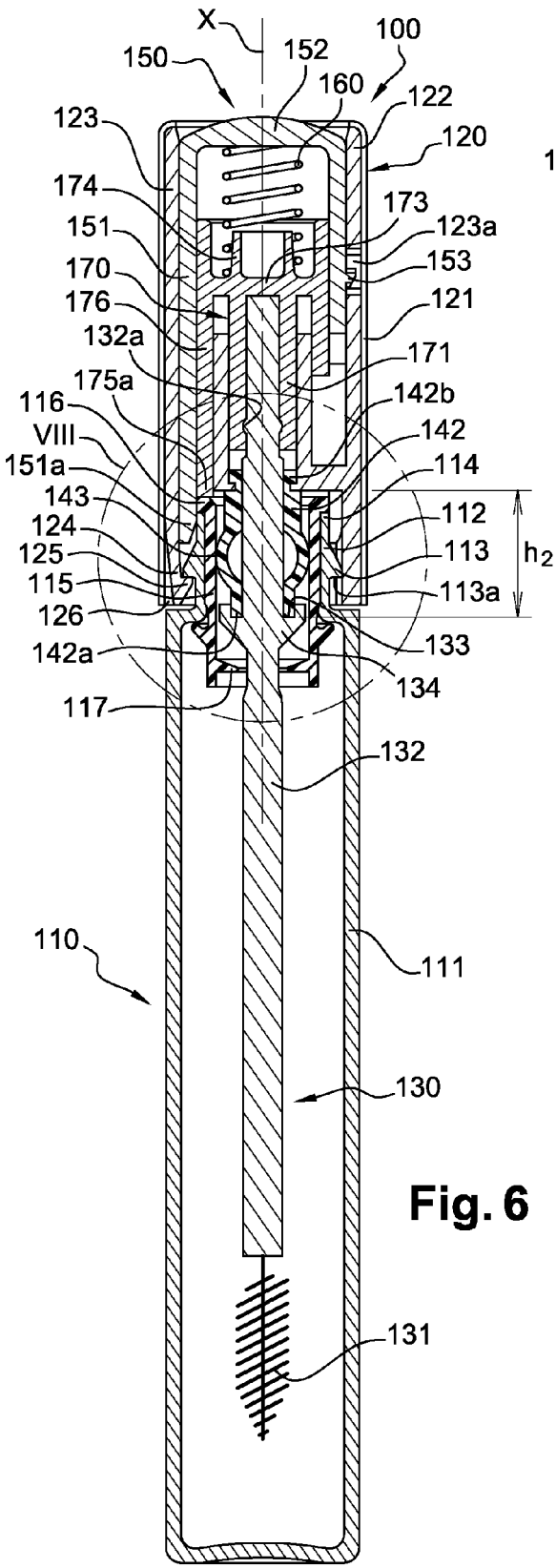
Figure 7:
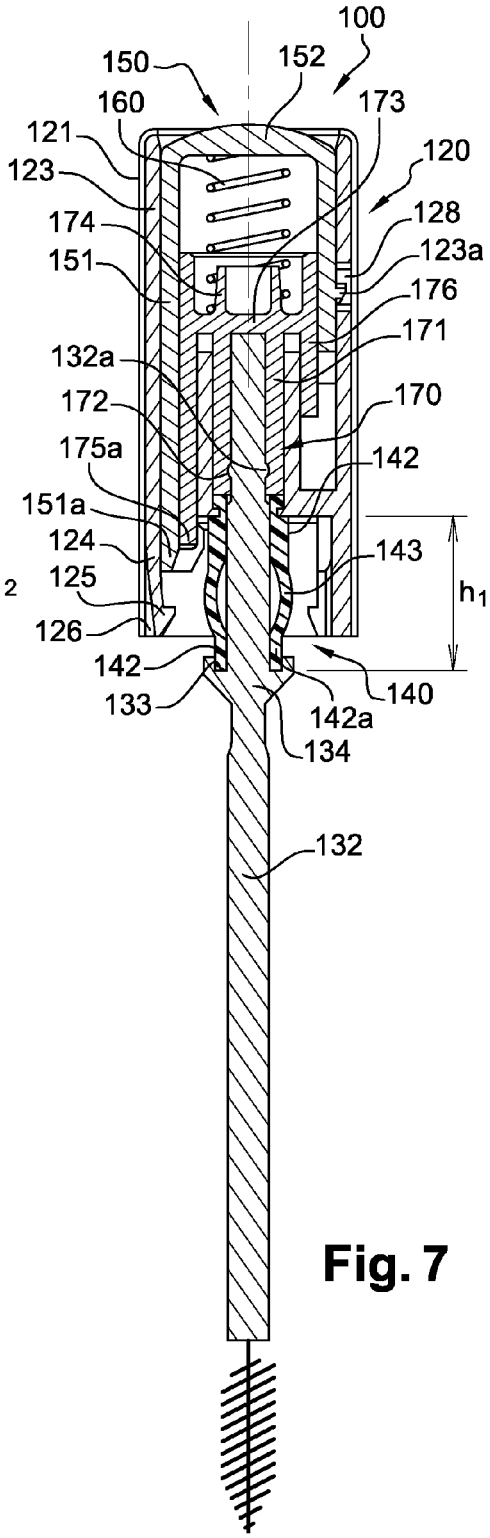

FIGS. 6 and 7 show a second example of a device for packaging a cosmetic product according to the invention, in the form of a small mascara bottle.

This device 100 comprises a container 110 comprising an opening of axis X, the container having for example an elongate form along the same axis X. It also comprises an applicator 130 provided with a brush 131 fixed at the end of a wand 132 of axis X, and also a wiping member 115 permanently fixed on the container 110. The wand 132 is connected at its upper end to a gripping member that also constitutes a closure cap 120 of the container 110, said closure cap 120 being intended to close the container in a reversible manner. According to this second example, the container and the closure cap have a circular cross section. Alternatively, they may have a cross section which is not circular, in particular a polygonal or oval cross section.

The container 110 comprises a body 111 which contains the product and the upper part of which is provided, in the example in question, with a neck 112. The upper end 114 of the neck defines an opening in which the wiping member 115 is inserted. In the upper part, the wiping member 115 comprises a flange 116 that butts against the upper part 114 of the neck 112. In the lower part, the wiping member 115 comprises an annular wiping lip 117 that defines an orifice having a circular cross section, this lip 117 being arranged such as to press against the wand 132 and/or against the brush 131 as the applicator 130 is withdrawn from the container.

According to the example illustrated, the closure cap 120 is fixed to the container 110 in a reversible manner by snap-fastening. Alternatively, it is also possible to provide for the closure cap to be fixed by clamping or by any other type of fixing. The container is opened in response to the actuation of an actuating member 150.

In order to fix the cap to the container, the neck 112 of the container is provided on the outside with a catching bulge 113 which comprises a lower face 113*a* that extends in a plane transversely to the axis X and an upper face that extends in a progressively decreasing inclined plane. The catching bulge 113 engages with catching lugs 124 that are provided on the inside of the closure cap.

Figure 9:
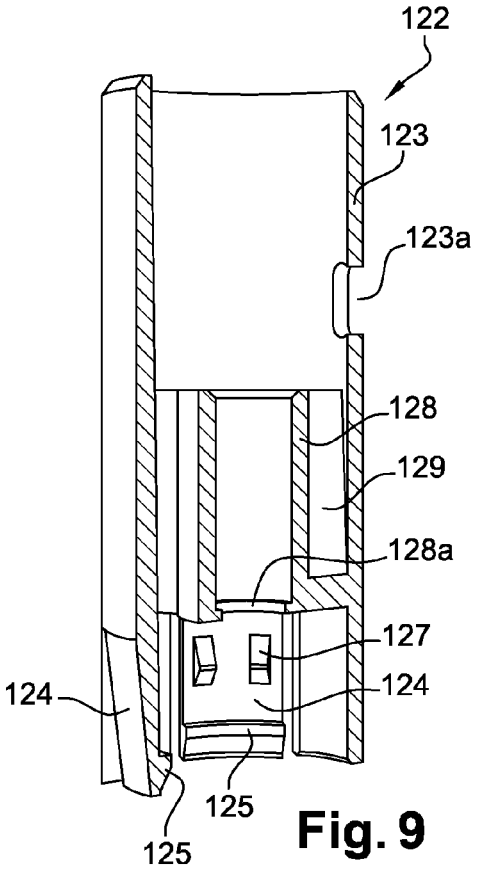
FIGS. 9 to 11 illustrate, in isolation, different parts of the closing member of the device from FIG. 6.

In particular, the closure cap 120 comprises an outer shell 121 formed by a cylindrical wall that is open at its two ends. The outer shell may be for example metallic. An insert 122, which is illustrated in isolation in FIG. 9, is provided inside the shell 121, to which it is secured. The insert 122 comprises a cylindrical wall 123 that extends axially from the upper end of the shell as far as its lower end and has catching lugs 124 in its lower part. In the example illustrated, three catching lugs 124 are provided and are spaced apart radially from one another. Each lug 124 has a radial catching ridge 125 that faces towards the inside of the cap and is intended to be fixed under the bulge 113 of the neck so as to keep the closure cap on the container. A radial clearance 126 is provided between the lugs and the outer shell 121 in order to enable the lugs 124 to be displaced while the closure cap is being opened and closed.

Above the catching ridge 125 and spaced apart therefrom, each lug has two projections 127 that extend radially inwards, each radial projection comprising a lower face that extends in an inclined plane as far as a peak and an upper face that extends likewise in an inclined plane that decreases from the peak to form a triangle. As will be seen in detail below, the projections 127 are involved in the opening and closing of the closure cap.

As can be seen in FIG. 9, a tubular support 128 that is concentric with the cylindrical wall 123 of the insert 122 is connected to said cylindrical wall 123 by three axial uprights 129 that are angularly spaced apart from one another. The axial uprights 129 extend radially in the direction of the axis X between the cylindrical wall 123 and the tubular support 128. The tubular support 128 comprises an annular bead 128*a* that projects radially towards the axis X so as to hold a sealing member 140. According to the example illustrated, the tubular support 128 is produced in one piece with the cylindrical wall 123 and the uprights 129.

Figure 10:
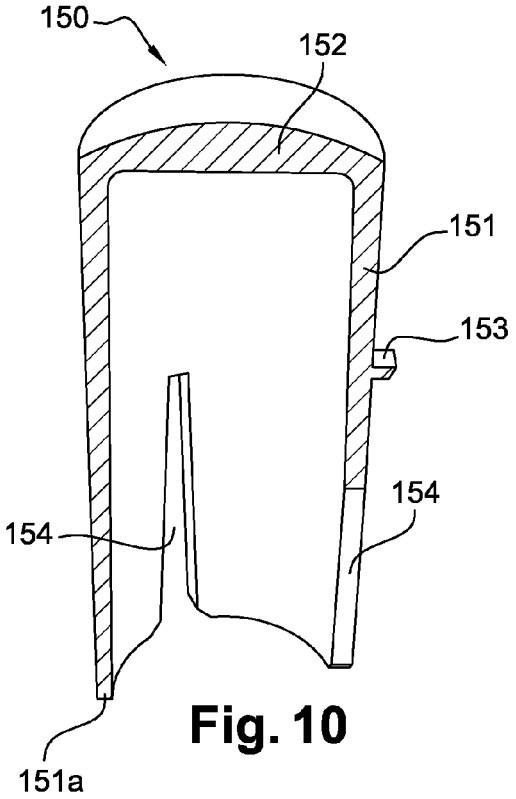

In order to actuate the opening of the cap, an actuating member 150 in the form of a pushbutton is provided in the cap, the pushbutton being illustrated in isolation in FIG. 10. In particular, the pushbutton 150 is mounted such that it can slide inside the cylindrical wall 123 of the insert. It comprises a cylindrical side wall 151 which is connected at the top to a side wall 152 that is perpendicular to the axis X. Three axial slots 154, which are spaced apart angularly, extend in the side wall 151 of the pushbutton, the axial uprights 129 of the insert 122 extending through said axial slots 154. The transverse wall 152 of the pushbutton serves as an actuating surface. Three protrusions 153 are provided on the outer surface of the side wall 151 and are spaced apart angularly from one another. Each protrusion 153 is housed in one of three windows 123*a* provided in the cylindrical wall 123 of the insert, said windows 123*a* being spaced apart angularly from one another. The protrusions 153 are housed therein with sufficient clearance to enable the pushbutton 150 to move with respect to the cap 120, while limiting its displacement. The lower end 151*a* of the side wall of the pushbutton is designed to move, in the bottom position, on the upper face of the projections 127.

Figure 11:
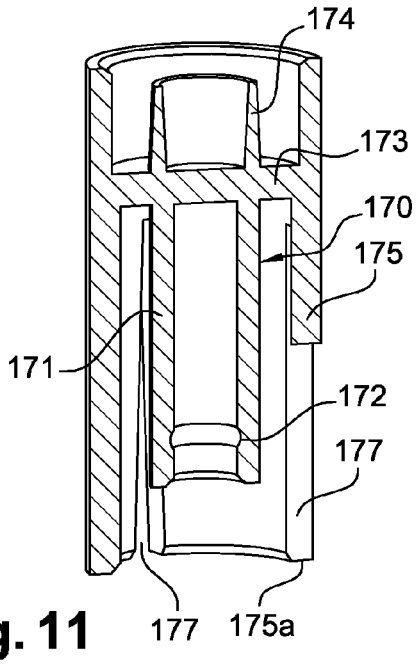

The wand 131 is held in the closure cap by a wand holder 170, which is shown in isolation in FIG. 11, comprising a tubular skirt 171 which has a circular cross section, is open at its lower end and in which the upper end of the wand 132 is fitted. In order to improve the catching of the wand in the support an annular bead 132*a* is provided on the wand in order to be housed in an annular groove 172 provided on the inner surface of the skirt. The tubular skirt 171 carrying the wand is closed in its upper part by a transverse wall 173, from which a tubular portion 174 rises in the opposite direction to the skirt 171.

An elastic return member 160 is disposed between the pushbutton 150 and the wand holder. More particularly, a compression spring is fixed to the transverse wall 152 of the pushbutton 150 and to the transverse wall 173, surrounding the tubular portion 174 so as to push these two components away from one another.

The transverse wall 173 of the wand holder 170 is surrounded, at its periphery, by a holding element in the form of a tubular sleeve 175 that extends axially on either side of the transverse wall 173, the tubular sleeve being coaxial with the tubular skirt 171. Three axial slots 177, which are spaced apart angularly, extend in the tubular sleeve 175, the axial uprights 129 of the insert 122 extending through said axial slots 177. The lower end 175*a* of the tubular sleeve 175 axially extends beyond the tubular skirt 171. As will be seen later on in the description, the tubular sleeve 175 is disposed such that the lower end 175*a* is able to butt against the container, and in particular against the flange 116 of the wiping member.

In order to ensure that the closure of the small mascara bottle is sealed, a sealing member 140 comprising an elastically deformable seal 142 is provided. According to this embodiment, the seal 142 is tubular. It is mounted around the wand 132 such that it can slide above, at least in part. In particular, the lower end 142*a* of the seal is housed in a groove 133 formed in a widened portion 134 of the wand. The tubular seal 142 comprises, between its two ends, a domed part 143 which is configured to be able to deform by bulging to a greater or lesser extent by the two ends of the seal being moved closer together to a greater or lesser extent. At its upper end 142*b*, the seal is held by the annular bead 128*a* of the tubular support 128. The seal is housed in a space 180 having an axial height h defined between the annular bead 128*a* of the support 128 and the groove 133 in the wand.

Figure 8:
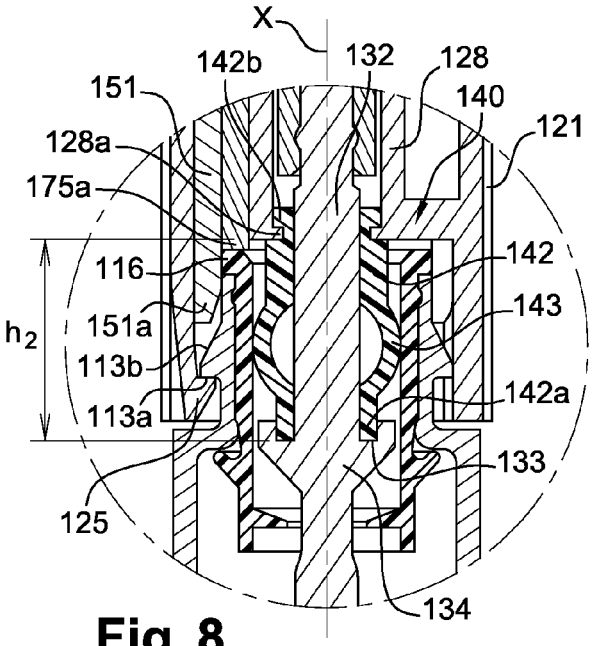
FIG. 8 shows a detail from FIG. 6.

In the closed position of the small mascara bottle, which is illustrated in FIGS. 6 and 8, the catching lugs 124 of the closure cap engage with the catching bulge 113 on the neck, the radial catching ridge 125 being housed under the catching bulge 113 and being held in particular by the face 113*a* of the bulge.

In order to open the small bottle, the user depresses the pushbutton 150 by pressing on the actuating surface 152. The lower end 151*a* of the side wall of the pushbutton, which was located above the radial projections 127, butts against the upper face of the projections. The lugs 124 are thus spaced apart towards the outside until the catching ridges 125 of the bulge 113 disengage and the closure cap is released. The cap can then be removed from the container. Since the sleeve 175 is in abutment against the container, it is not depressed when the pushbutton is depressed. When the user releases it, the pushbutton 150 is returned into its initial position with respect to the sleeve 175 by the elastic return of the spring 160, which spaces the two components apart from one another.

In order to close the small bottle again, the user replaces the closure cap on the neck. There again, the catching lugs 124 are spaced apart radially from the neck when the lower face of the catching ridge 125 slides on the upper face 113*b* of the bulge 113 on the neck. By extending the depression of the closure cap, the catching ridges 125 are housed under the catching bulge 113 on the neck.

When the small mascara bottle is opened as illustrated in FIG. 7, the wand holder 170 and the wand 132 are in the lowest axial position in relation to the cap. This is because the spring 160 has pushed the wand holder and the wand away from the pushbutton. The lower end 142*a* of the seal is in its position which is axially furthest away from the upper end 142*b*, the space 180 having an axial height h1. The domed part 143 of the seal is domed to a small extent.

When the closure cap 120 is closed, as illustrated in FIG. 6, the cap 120, the pushbutton 150 and the applicator 130 are moved by being brought together towards the container. Before the closure cap is in its closed position, the lower end 175*a* of the tubular sleeve 175 butts against the flange 116 of the wiping member such that the tubular sleeve 175, the wand holder and the applicator can no longer move axially with respect to the container. The spring 160, which is secured to the sleeve 175, is compressed, thereby allowing the axial movement of the closure cap towards the container to be extended. The lower end 142*a* of the seal, which is resting in the groove 133 in the wand, is then in a fixed axial position with respect to the cap. The cap 120 continues to move axially towards the container until it catches on the neck of the container. Since the tubular support 175 holding the upper end 142*b* of the seal is secured to the cap, this end 142*b* of the seal moves axially in relation to the wand by being brought towards the lower end 142*a*. In the closed position, the axial height of the space 180 is reduced such that the seal 142 is axially compressed, the height h2 of the space 180 in this position being less than h1, the axial height varying by a distance of for example between 1.5 and 5 mm. The domed part 143 of the seal domes further such that a contour of the domed part butts radially against a perimeter of the inner surface of the wiping member 115.

The container 110 is then closed by the wand located inside the wiper and by the seal 142, which ensures this closure between the wand and the wiper is sealed.

In the above detailed description, reference has been made to preferred embodiments of the invention. It is clear that alternatives thereto can be made without departing from the scope of the invention as claimed hereinbelow.

The invention claimed is:

1. A device for packaging a cosmetic product, the device comprising:

a container comprising an opening;

a closing member for closing the opening of the container, the closing member configured to be movable between an open position of the container and a closed position of the container;

a support mounted to the closing member;

a holding element mounted to the closing member and configured to be movable along a longitudinal axis of the closing member, wherein the holding element rests against a portion of the container before the closing member is in the closed position of the container, wherein the holding element comprises a plate and a skirt, the skirt configured to be slidable along the support, the skirt including a flange configured to butt against an upper edge of the support to limit movement of the holding element away from the closing member, and a sealing member disposed within a space between the plate and the support.

2. The device according to claim 1, wherein an axial height of the space varies between about 0.5 mm and about 5 mm between the closed position and the open position of the container.

3. The device according to claim 2, wherein an axial height of the space varies between about 1.5 mm and about 3.5 mm between the closed position and the open position of the container.

4. The device according to claim 1, further comprising an elastically deformable element positioned between the holding element and the closing member.

5. The device according to claim 4, wherein the elastically deformable element is a spring.

6. The device according to claim 1, wherein the sealing member comprises a seal made of at least one of an elastomeric rubber material and a thermoplastic material.

7. The device according to claim 1, wherein the sealing member is annular.

8. The device according to claim 1, wherein the sealing member has a hollow cross section having a shape including at least one of a U, a circle, an oval, a C, an X, a square, and a trapezium.

9. The device according to claim 1, wherein the container comprises a removable refill element.

10. The device according to claim 9, wherein the refill element comprises a side wall having a shoulder that defines a supporting edge for the holding element.

11. The device according to claim 1, wherein the container comprises a side wall having a shoulder that defines a supporting edge for the holding element.

12. The device according to claim 11, wherein the sealing member is pressed against a perimeter of the side wall above the shoulder in the closed position.

13. The device according to claim 1, wherein an upper edge of the container defines a supporting edge for the holding element.

14. The device according to claim 1, wherein the container comprises a wiping member, and wherein the sealing member rests against a perimeter of the wiping member in the closed position of the container.

15. The device according to claim 14, wherein the sealing member widens radially at a portion between first and second ends, and wherein the radially-widened portion is configured to rest against the perimeter of the wiping member.

16. The device according to claim 1, wherein the closing member is secured to a wand that carries an applicator, and wherein the holding element is secured to the wand.

17. The device according to claim 16, wherein the applicator is a brush.

18. The device according to claim 16, wherein the sealing member is a tube that surrounds the wand.

19. The device according to claim 1, wherein the closing member is fixed on the container in a reversible manner other than by screwing the closing member on the container.

20. The device according to claim 1, wherein, when axially compressed, the sealing member widens radially to rest against a perimeter of the container.

21. The device according to claim 1, further comprising a cosmetic product contained within the container.

22. The device according to claim 21, wherein the cosmetic product is contained within a removable refill element of the container.

* * * * *